US005307909A

United States Patent [19]

Nitkin et al.

[11] Patent Number: 5,307,909

[45] Date of Patent: May 3, 1994

[54] DISPLAY DEVICE FOR LUGGAGE

[75] Inventors: Andrew J. Nitkin, Yardley; Mary C. Sullivan, Doylestown, both of Pa.

[73] Assignee: York Partners, L.P., Lambertville, N.J.

[21] Appl. No.: 623

[22] Filed: Jan. 5, 1993

[51] Int. Cl.[5] ..... A45C 3/08; A45C 13/00; A45C 13/40

[52] U.S. Cl. ..... 190/26; 190/100; 190/102; 150/154

[58] Field of Search ..... 206/525; 150/104, 105, 150/154, 159, 164; 217/3 B C; 190/100, 102, 26

[56] References Cited

U.S. PATENT DOCUMENTS

| | | | |
|---|---|---|---|
| 1,598,954 | 9/1926 | Bigler | 190/26 |
| 4,318,505 | 3/1982 | Cordell Jr. | 190/100 |
| 4,598,803 | 7/1986 | Ghiassi | 190/102 |
| 5,083,644 | 1/1992 | Collins III | 150/154 |

FOREIGN PATENT DOCUMENTS

| | | | |
|---|---|---|---|
| 157027 | 9/1939 | Fed. Rep. of Germany | 150/154 |
| 548626 | 10/1922 | France | 190/26 |
| 2143431 | 2/1985 | United Kingdom | 150/154 |

*Primary Examiner*—David T. Fidei
*Attorney, Agent, or Firm*—Shapiro and Shapiro

[57] ABSTRACT

A display device for a luggage case comprises a cap in the form of a sleeve adapted to embrace a top portion of a luggage case, in which other pieces of a matched set of luggage may be nested. The sleeve has a slot in a top wall, through which a top handle of the luggage case projects, and has a retainer that extends inside the luggage case. The retainer has a stem embraced by sliders of a zipper of the case and has a cross bar positioned behind a front wall of the case.

14 Claims, 1 Drawing Sheet

DISPLAY DEVICE FOR LUGGAGE

BACKGROUND OF THE INVENTION

This invention is concerned with display devices for luggage, and is more particularly concerned with a point-of-sale display device for a nested luggage set.

Retailers have customarily sold luggage with different types of point-of-sale display devices. For example, the luggage may be enclosed in a box that serves as a display device, or a luggage case may be wrapped in a band that serves as a display device. Each of these display devices has drawbacks. When a box is used, the consumer cannot see the actual luggage without opening the box. While a band allows the consumer to see most of the exterior of a luggage case without removing the band, the interior of the case cannot be seen without breaking the band. Also, bands tend to be fragile and easily torn off.

BRIEF DESCRIPTION OF THE INVENTION

The present invention provides a point-of-sale display device for luggage that is free of the drawbacks of the prior art.

The display device of the invention is a cap in the form of a sleeve that embraces a top portion of a luggage case, in which other pieces of a luggage set may be nested. The sleeve is held in position by a retainer having a portion inside the case behind a zippered front wall of the case and having a portion that is embraced by zipper sliders when the zipper is closed. The sleeve may display the usual graphics. With the invention, most of the exterior of a luggage case can be viewed by a consumer. Moreover, to examine the interior, the luggage case can be opened without disturbing the sleeve.

BRIEF DESCRIPTION OF THE DRAWINGS

The invention will be further described in conjunction with the accompanying drawings, with illustrate a preferred (best mode) embodiment, and wherein.

DETAILED DESCRIPTION OF THE INVENTION

Figure 1:
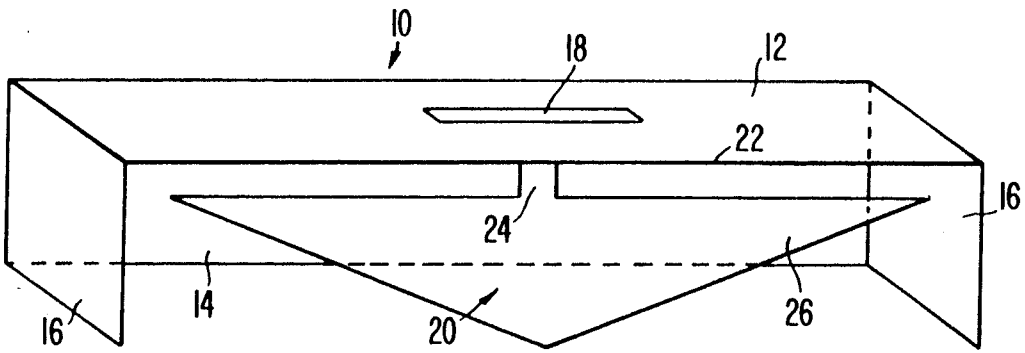
FIG. 1 is a perspective view of a point-of-sale display device in accordance with the invention.

As shown in FIG. 1, a display device 10 in accordance with the invention is a cap in the form of a sleeve having a top wall 12, a back wall 14, and a pair of side walls 16. The top wall has a central slot 18 for passing a top handle of a luggage case. A retainer 20 depends from a front edge 22 of the top wall and includes a stem 24 and a cross bar 26. The stem 24 has a top end connected to the top wall 12 and has a bottom end connected to the cross bar 26. The stem is located centrally of the front edge 22 and has a dimension parallel thereto that is a small fraction of the corresponding dimension of the front edge. The cross bar 26 extends in opposite directions from the stem toward respective side walls 16 of the sleeve and has a dimension parallel to the front edge 22 that is substantially greater than the corresponding dimension of the stem. The upper edges of the cross bar at opposite sides of the stem extend along and are spaced from the front edge 22, as shown in FIG. 1. The cross bar is preferably triangular, so that the stem and cross bar form the shape of an arrow pointing downwardly.

Figure 2:
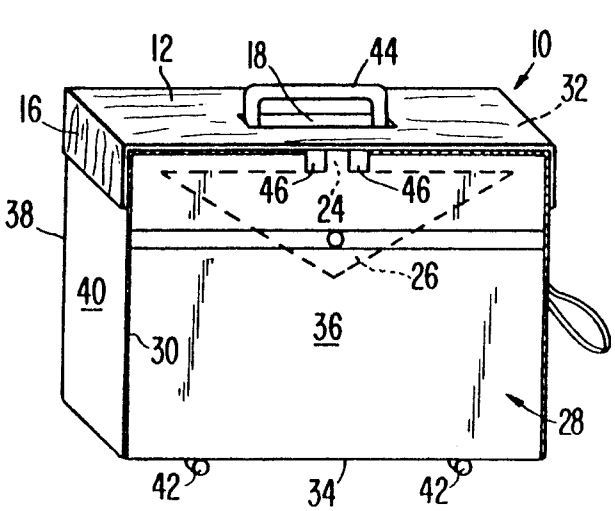
FIGS. 2 and 3 are front and back views, respectively, showing the display device of the invention in use on a luggage case.
Figure 3:
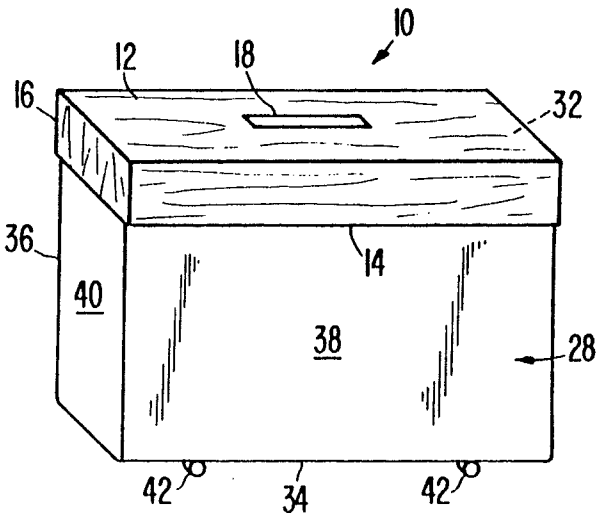

FIGS. 2 and 3 illustrate the display device 10 of the invention in use on a luggage case 28. The case may be a standard soft-sided pullman case with a zipper closure. The case has the usual top wall 32, bottom wall 34, front wall 36, back wall 38, and side walls 40 and may be supported on casters 42, for example. The bottom portion of the front wall is flexibly attached to the bottom wall 34 of the case, and a zipper 30 extends around the side and top edges of the front wall in the usual manner. The luggage case shown in FIGS. 2 and 3 may contain, nested therein, other pieces of a matched set of luggage (not shown).

As shown in FIGS. 2 and 3, the display device 10 of the invention embraces a top portion of the luggage case 28, with a top handle 44 of the luggage case projecting through the slot 18 in the top wall 12 of the display device. The top, back, and side walls of the display device overlap corresponding walls of the luggage case. In the preferred form of the invention, the top wall of the display device covers the top wall of the luggage case substantially entirely, while the back wall and the side walls of the display device cover only minor portions of the respective back wall and side walls of the luggage case.

The cross bar 26 of the retainer 20 is positioned inside of the luggage case adjacent to the front wall 36, and the stem 24 of the retainer is embraced by a pair of sliders 46 of the zipper when the zipper is closed, so that the display device is held securely to the top portion of the luggage case.

The display device of the invention is preferably formed of cardboard and may display the usual type of graphics employed in a point-of-sale display device. However, the device of the invention may be partially or entirely transparent or translucent and may be formed partially or entirely of plastic, for example.

When the display device of the invention is in use, most of the exterior of a luggage case on which the display device is mounted is visible to the consumer. The graphics on the display device may refer to the fact that the luggage is sold as a set and may invite the consumer to open the zipper for examination of other pieces of the set. The luggage case on which the display device is mounted can be opened without disturbing the display device in any way. Thus, the display device of the invention complements the advertisement constituted by the luggage itself and enhances the salability of luggage.

While a preferred embodiment of the invention has been shown and described, it will be apparent to those skilled in the art that changes can be made in this embodiment without departing from the principles and spirit of the invention, the scope of which is defined in the appended claims. Terms such as "top . . . bottom . . . upper . . . lower" are used herein with reference to structures oriented as shown in the drawings, but the orientation may, of course, be changed.

We claim:

1. A display device for a luggage case having top and bottom walls, front and back walls, and side walls, the front wall having a lower portion flexibly attached to the bottom wall and having a zipper along side and top edges, the display device comprising a sleeve having a top wall adapted to overlap the top wall of the luggage case, a back wall adapted to overlap the back wall of the luggage case, and side walls adapted to overlap respective side walls of the luggage case, and retaining means depending from a front edge of the top wall of the sleeve, the retaining means including a stem having a top end connected to the top wall of the sleeve and a cross-bar connected to a bottom end of the stem, the cross bar having an upper edge that extends along and is spaced from the front edge of the top wall of the sleeve, the cross bar being adapted to be retained inside the case behind the front wall of the case.

2. A display device according to claim 1, wherein the top wall of the sleeve is dimensioned so as to cover the top wall of the luggage case, and the back wall and side walls of the sleeve are dimensioned so as to overlap only minor portions of the respective back wall and side walls of the luggage case.

3. A display device according to claim 2, wherein the top wall of the sleeve has a slot for passing a top handle of the luggage case.

4. A display device according to claim 1, wherein the stem depends from a central region of said front edge and the cross bar extends in opposite directions from the stem toward respective side walls of the sleeve.

5. A display device according to claim 4, wherein the cross bar is triangular and the stem and cross bar form the shape of an arrow pointing downward from the top wall of the sleeve.

6. In combination with a luggage case having top and bottom walls, front and back walls, and side walls, the front wall having a lower portion flexibly attached to the bottom wall and having a zipper along side and top edges, a display device comprising a sleeve mounted on a top portion of the luggage case and having a top wall overlapping the top wall of the luggage case, a back wall overlapping the back wall of the luggage case, and side walls overlapping respective side walls of the luggage case, and retaining means depending from a front edge of the top wall of the sleeve, the retaining means including a stem having a top end connected to the top wall of the sleeve and a cross-bar connected to a bottom end of the stem, the stem having a dimension along the front edge of the top wall of the sleeve that is a fraction of the corresponding dimension of the front edge, and the cross bar having a corresponding dimension that is substantially greater than that of the stem, the cross bar being disposed inside the case behind the front wall of the case, with sliders of the zipper embracing the stem.

7. A combination according to claim 6, wherein the top wall of the sleeve covers the top wall of the luggage case, and the back wall and side walls of the sleeve overlap only minor portions of the respective back wall and side walls of the luggage case.

8. A combination according to claim 7, wherein the top wall of the sleeve has a slot passing a top handle of the luggage case.

9. A combination according to claim 6, wherein the stem depends from a central region of the front edge of the sleeve, and the cross bar extends in opposite directions from the stem toward respective side walls of the sleeve.

10. A combination according to claim 9, wherein the cross bar is triangular and the stem and cross bar form the shape of an arrow pointing downward from the top wall of the sleeve.

11. A display device for a zippered luggage case comprising a cap adapted to be placed over a top portion of the luggage case, the cap having a top wall adapted to cover a top wall of the luggage case, a back wall and side walls adapted to overlap only portions of respective back and side walls of the luggage case, and a retainer having a stem depending from a front edge of the top wall of the cap and adapted to be embraced by zipper sliders and having a cross bar depending from the stem and adapted to be held inside the luggage case, the cross bar extending in opposite directions from the stem toward respective side walls of the cap and having upper edges at opposite sides of the stem that extend along and are spaced from the front edge of the top wall of the cap.

12. A display device according to claim 11, wherein the top wall of the cap has a slot for passing a top handle of the luggage case.

13. A display device according to claim 11, wherein the cross bar is triangular and the stem and cross bar form the shape o an arrow pointing downwardly from the top wall of the cap.

14. A display device according to claim 1, wherein the stem has a dimension along the front edge of the top wall of the sleeve that is a fraction of the corresponding dimension of the front edge, and the cross bar has a corresponding dimension that is substantially greater than that of the stem.

* * * * *